United States Patent [19]

Hart

[11] Patent Number: 5,058,940

[45] Date of Patent: Oct. 22, 1991

[54] AUTOMATIC DEAD LOCKING BOLT ASSEMBLY

[76] Inventor: Leroy Hart, 20 Cope Farms Rd., Farmington, Conn. 06032

[21] Appl. No.: 560,423

[22] Filed: Jul. 31, 1990

[51] Int. Cl.[5] ..... E05C 1/16

[52] U.S. Cl. ..... 292/167; 70/134; 292/153

[58] Field of Search ..... 292/167, 340, 169.13, 292/169.19, 153; 70/129, 134

[56] References Cited

U.S. PATENT DOCUMENTS 2,650,121 8/1953 Schlage ..... 292/167

3,036,850 5/1962 Schmid ..... 292/167 X 4,272,974 6/1981 Hennessy ..... 70/129

*Primary Examiner*—Richard E. Moore

*Attorney, Agent, or Firm*—Chilton, Alix & Van Kirk

[57] ABSTRACT

An automatic dead bolt lock has a main bolt member and an auxiliary bolt member supported on the main bolt member so as to be reciprocally movable relative thereto. Both the main and auxiliary bolt members will be dead locked when the lock is in the dead locked condition. In the armed condition the main bolt member is partly extended and the auxiliary bolt member extends from the end of the main bolt member.

20 Claims, 14 Drawing Sheets

AUTOMATIC DEAD LOCKING BOLT ASSEMBLY

BACKGROUND OF THE INVENTION

1. Field of the Invention

The present invention relates to security devices and particularly to automatic dead bolt locks. More specifically, this invention is directed to the accomplishment of an automatic dead bolting function, either alone or in combination with a hold back function, in a single lock. Accordingly, the general objects of the present invention are to provide novel and improved apparatus and methods of such character.

2. Description of the Prior Art

A tubular dead bolt lock which has enjoyed wide commercial success is disclosed in U.S. Pat. No. 4,272,974. A particularly important feature of the patented lock is the long bolt "throw", i.e., the large amount of linear motion imparted to the bolt in response to less than 180° of rotation of the inside or outside actuator. Long bolt throw, i.e., at least one inch of linear motion, is considered essential in order for a dead bolt lock to provide adequate security. A disadvantage of the lock of U.S. Pat. No. 4,272,974, for some applications, resides in the fact that a deliberate manual operation is required in order to accomplish the deadlocking function. Another tubular dead bolt, having the same disadvantage, is disclosed in U.S. Pat. No. 4,333,324.

Automatic dead bolt locks have previously been proposed. Examples of such proposed designs may be seen from U.S. Pat. Nos. 4,561,684 and 4,671,549. The previously proposed automatic dead bolt locks have been characterized by one or more serious deficiencies. A first of these deficiencies is short, i.e., less than one inch, bolt throw. Another common problem is that the lock, when set in the "armed" position, has the bolt fully retracted. Thus, a closed but not dead locked door may simply be pushed open. An additional disadvantage of prior dead bolt locks has been a lack of versatility. Thus, there has not previously been available a dead bolt lock assembly which could be installed without modification on left or right hand doors and/or on reverse bevel doors.

SUMMARY OF THE INVENTION

The present invention overcomes the above-briefly discussed and other deficiencies and disadvantages of the prior art by providing a novel method and apparatus for accomplishing the automatic projection of the bolt of a dead bolt lock. Thus, a lock assembly in accordance with the present invention does not require, to employ the dead bolting function, use of a key or other actuator. A lock assembly in accordance with the present invention may also be characterized by the ability to easily capture the bolt in the fully retracted position when desired thus enabling the user to select either the automatic dead bolting mode or the "hold-back" unlocked mode.

A bolt subassembly in accordance with the present invention comprises a housing which defines a tubular bolt receptacle. A main bolt member is mounted in this tubular receptacle for reciprocal movement, this main bolt member extending from a first end of said receptacle and the amount of such extension being varied during said reciprocal movement. The bolt subassembly also comprises a first spring for biasing the main bolt member in the direction of maximum extension from the tubular receptacle. A catch is mounted on the housing for defining a partly extended or armed position of the main bolt member. A cam follower cooperates with the catch and a bolt arm pivotally couples the cam follower to the bolt member. The bolt subassembly further includes means coupling the cam follower to the inside and outside actuators for the lock. The coupling means permits movement of the cam follower in two directions relative to the catch, a first of these directions of movement being in response to movement of the main bolt member.

An auxiliary bolt member is supported on the main bolt member and is capable of limited motion relative thereto in the directions of main bolt reciprocation. The auxiliary bolt member cooperates with the bolt arm to cause the bolt arm to move the cam follower in its second direction of motion in response to movement of the auxiliary bolt member relative to the main bolt member. A second spring is provided for resiliently biasing the auxiliary bolt member to cause the auxiliary bolt member to extend from the main bolt member. Movement of the auxiliary bolt member relative to the main bolt member in a direction opposite to the direction of the bias provided by the second spring, in response to the auxiliary bolt member contacting a door mounted strike when the main bolt member is in a partly retracted position, causes repositioning of the cam follower to a location where it is out of alignment with the catch whereby the main bolt member may move to the fully extended position. Means are also provided for engaging the cam follower when the main bolt member is in the fully extended position to thereby dead lock the main bolt member.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several FIGS. and in which.

DESCRIPTION OF THE DISCLOSED EMBODIMENT

Figure 5:
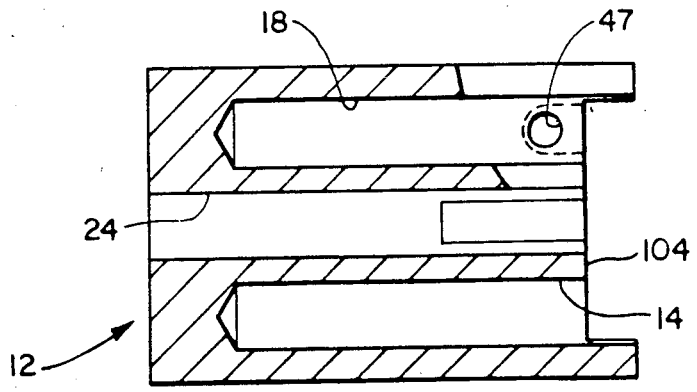
FIG. 5 is an enlarged cross-sectional view of the bolt head of the bolt subassembly of FIGS. 1 through 4.
Figure 6:
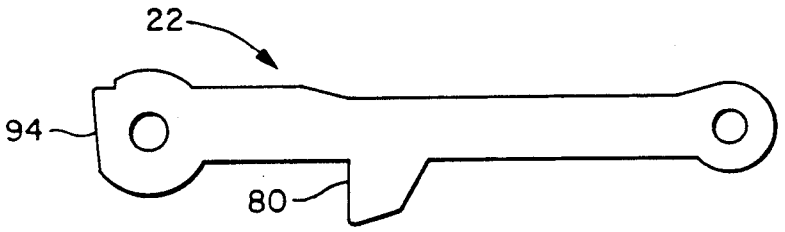
FIG. 6 is an enlarged side elevation view of the bolt arm of the bolt subassembly of FIGS. 1 through 4.
Figure 7A:
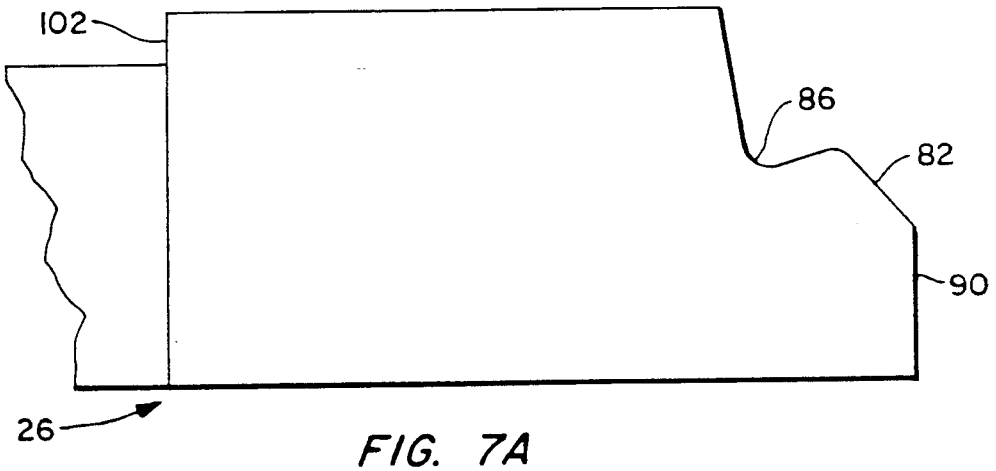
FIG. 7A is a partial side elevation view, on an enlarged scale, of the auxiliary bolt of the bolt subassembly of FIGS. 1 through 4.
Figure 7B:
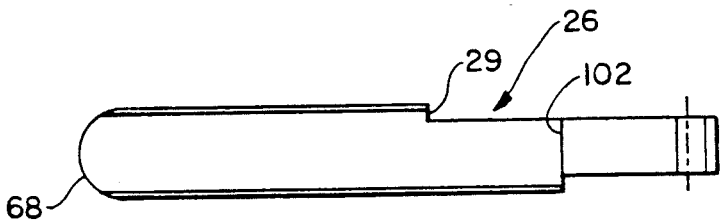
FIG. 7B is a top view of the entire auxiliary bolt of FIG. 7A, FIG. 7B being a smaller scale showing than that of FIG. 7A.

With reference now to the drawings, and also simultaneously referring to U.S. Pat. No. 4,272,974 for the purpose of facilitating understanding of the invention by reference to the depiction in FIG. 1 thereof of an entire lock assembly with which the present invention could be employed, a bolt subassembly in accordance with the present invention is indicated generally at 10. The bolt subassembly 10 includes a spring loaded main bolt or bolt head 12 which is provided with two bores formed about parallel axes. Thus, referring to FIGS. 1A and 5, a first bore 14, i.e., a blind hole in bolt head 12, receives the bolt spring 16 and its locating/stabilizing pin 17. A second blind hole 18 in bolt head 12 receives an operating spring 20 for a bolt arm 22, arm 22 being shown separately in FIG. 6. A slot 24, which is parallel with bores 14 and 18, receives a spring loaded auxiliary bolt 26 which is separately shown in FIGS. 7A and 7B. The biasing spring for auxiliary bolt 26 is indicated at 28 in FIG. 1A. Spring 28 is in compression between shoulder 29 on auxiliary bolt 26 (see FIG. 7B) and a plate 30 affixed to the inwardly disposed end of bolt head 12. Spring 28 thus biases the auxiliary bolt 26 to the position shown in FIGS. 1 and 1A where it defines an extension of the main bolt 12.

Figure 8:
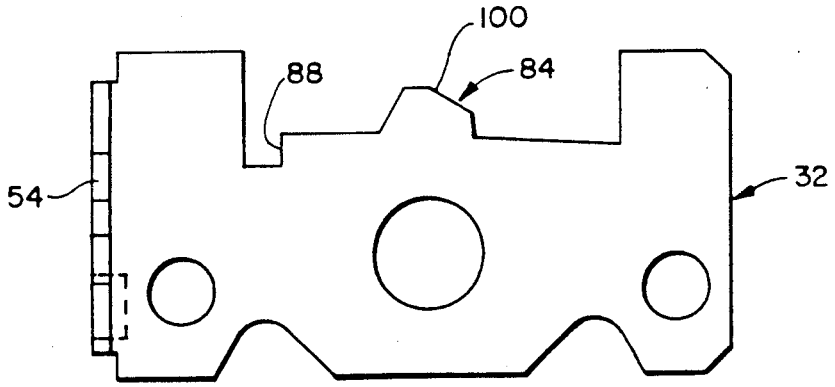
FIG. 8 is a side elevation view, on an enlarged scale, of one of the housing defining plates of the bolt subassembly of FIGS. 1 through 4.

The bolt subassembly 10 further includes a pair of oppositely disposed plates 31,32 with the right hand plate 32 being separately depicted in FIG. 8. The plates 31,32 are supported in parallel, spaced apart relationship through the use of a pair of spacer members 34. The spacer members 34 define through holes for receiving mounting bolts. Plates 31 and 32 define a housing which supports a rotatable hub 36. Mounting bolts may be passed through the spacer members to fix this housing to inside and outside actuators to provide an integrated lock assembly and thereby ensure smooth lock operation.

A lock which employs the present invention will typically have a key operated outside actuator. The outside actuator may be of the core removable type of may a key-in-knob type cylinder with a tail piece that engages hub 36. A lock employing the present invention will also have an inside actuator such as the manual actuator shown in FIGS. 11 through 17. A lever 38 is affixed to hub 36. Lever 38 is provided with a guide slot 42 which receives a cam follower 44. Cam follower 44 is affixed to a first end of bolt arm 22. The second end of arm 22, i.e., the end disposed oppositely with respect to cam follower 44, is pivotally connected to the bolt head 12 by means of a further pin 46. Pin 46 engages a hole 47 in the bolt head and thus arm 22 reciprocates with the bolt head.

The bolt subassembly also includes a tube 50, in which the main and auxiliary bolts can reciprocate, and a front flange plate 52. The inwardly disposed end of tube 50 is attached to the transversely extending flanges 54 which are located at the forwardly disposed ends of the plates 31 and 32.

Figure 1:
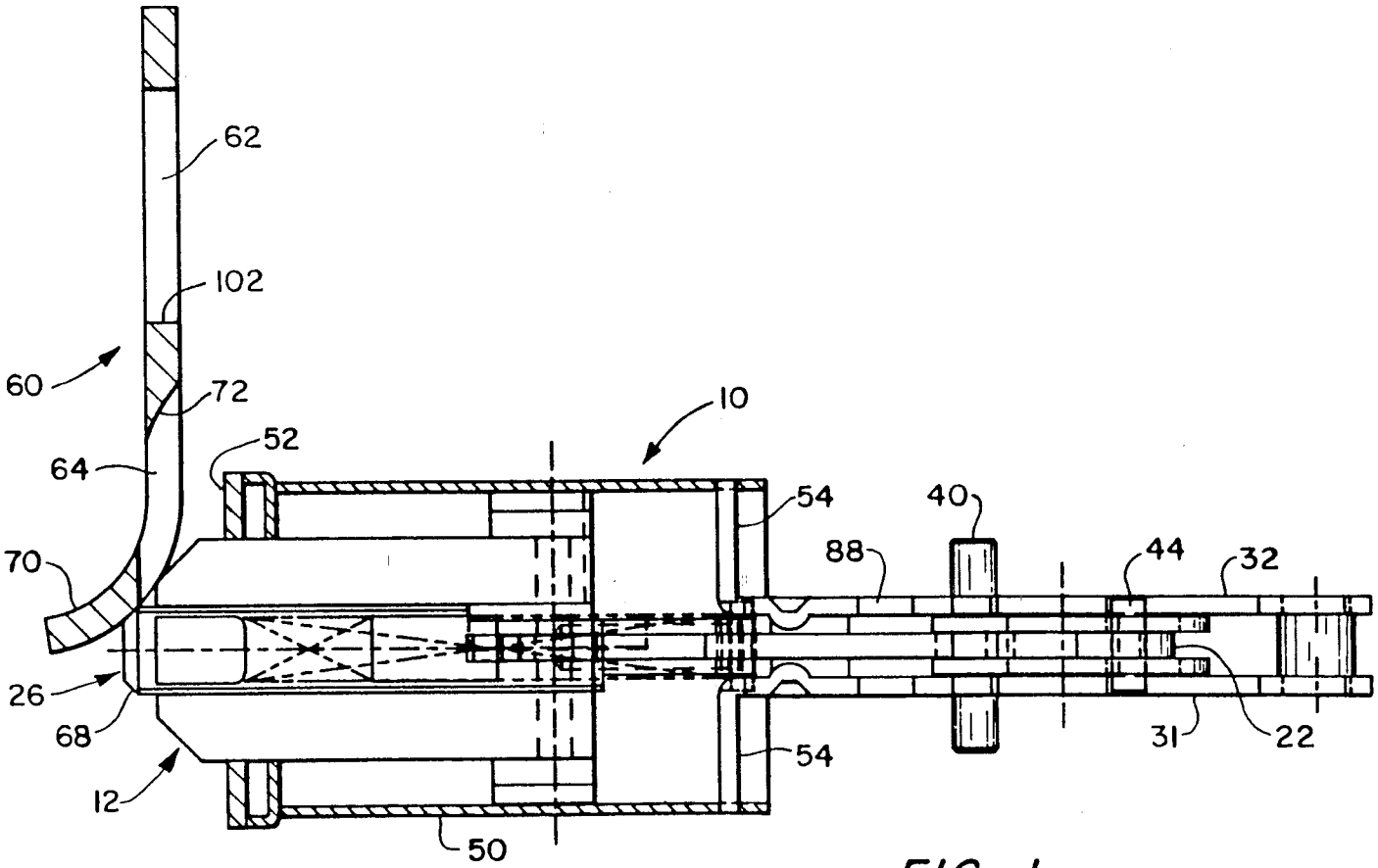
FIGS. 1 and 1A are respectively cross-sectional top and side elevation views of the bolt subassembly of a lock in accordance with a preferred embodiment of the invention, FIG. 1 showing the bolt subassembly in the armed condition.
Figure 1A:
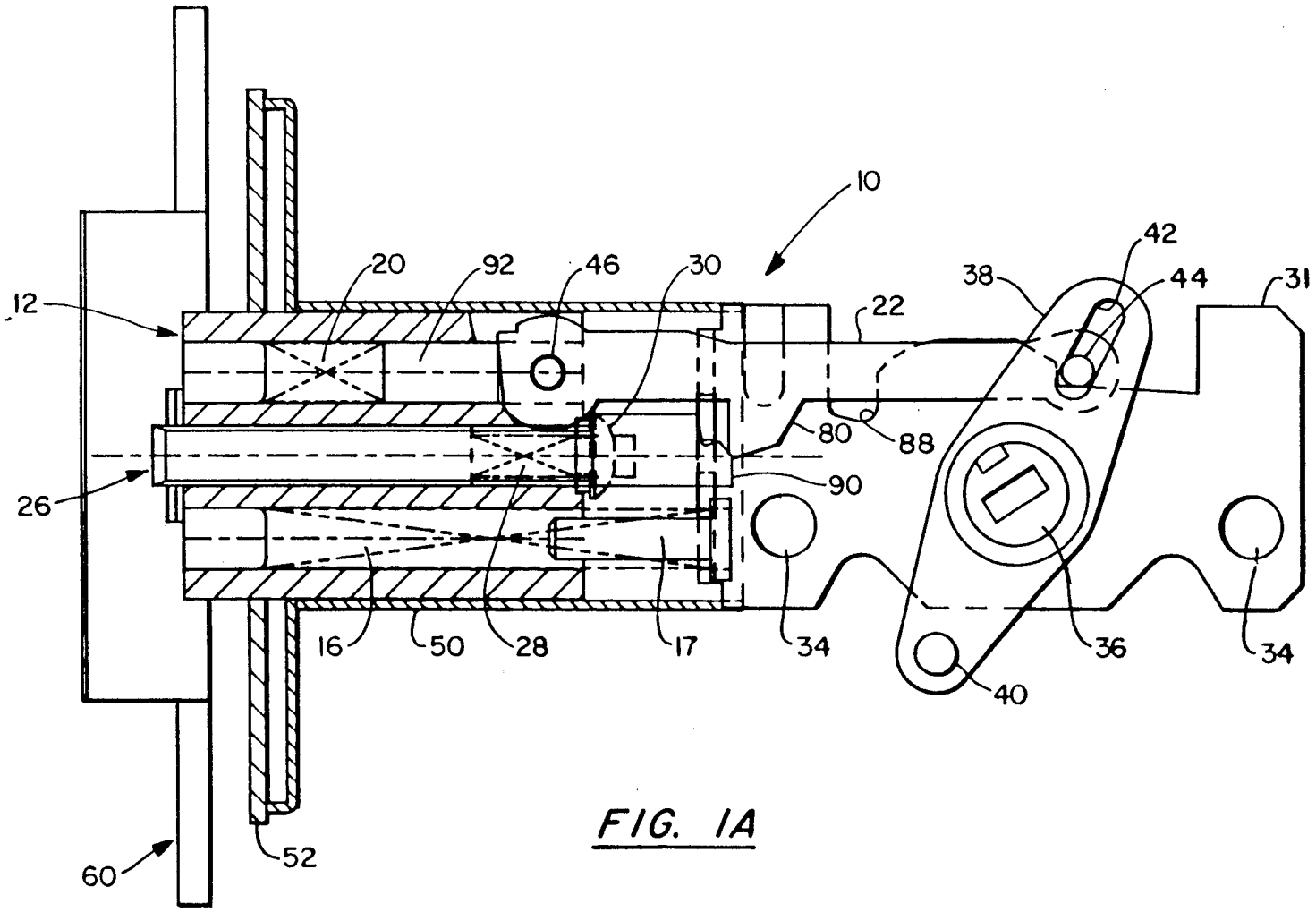
Figure 9A:
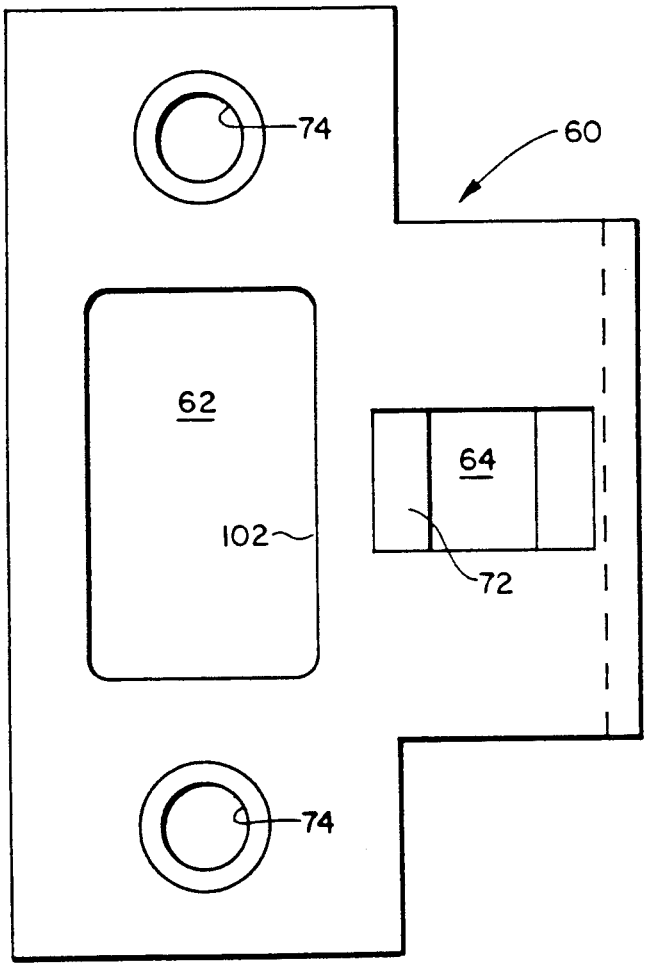
FIGS. 9A and 9B are respectively front and cross-sectional side elevation views of the strike of apparatus in accordance with the invention.
Figure 9B:
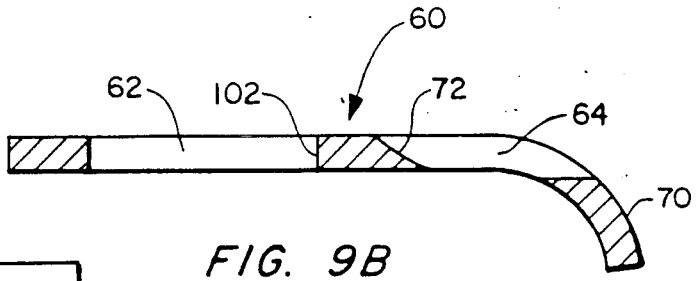
Figure 10A:
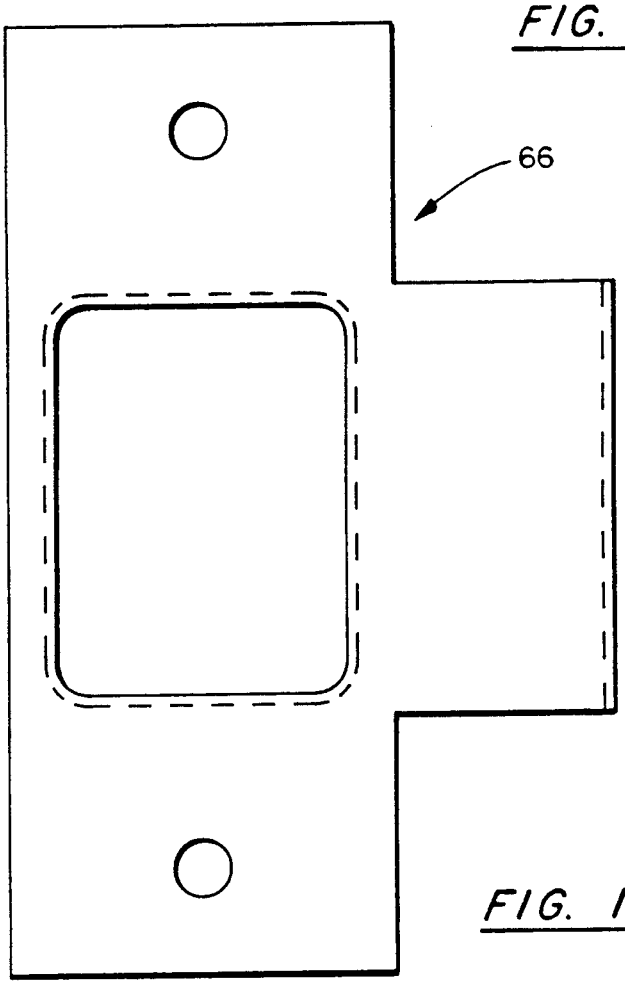
FIGS. 10A and 10B are respectively front and cross-sectional side elevation views of a strike box which will customarily be employed with the strike of FIGS. 9A and 9B.
Figure 10B:
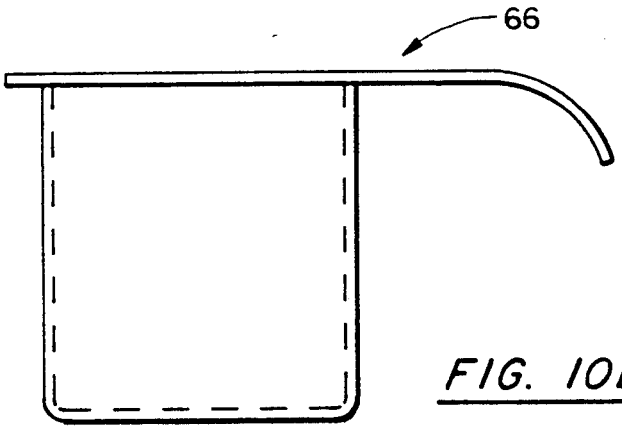

Referring to FIGS. 1A and 9, a strike which cooperates with the bolt subassembly 10 is indicated generally at 60. Strike 60 is generally T-shaped and is provided with a pair of openings 62 and 64. When the strike is mounted on a door jamb, the opening 62 will be aligned with a bolt recess formed in the jamb. A strike box 66, shown in FIGS. 10A and 10B, will customarily be positioned behind strike 60. Strike box 66 will define the dimensions of the bolt receiving recess in the door jam and will insure that, in the dead locking state of the lock, the bolt will be extended far enough to guard against its being trapped in an intermediate position. The strike box is provided with a lip which follows the contour of and extends across the opening 64 in strike 60 to prevent contact of the forward end 68 of auxiliary bolt 26 with the door jamb.

The opening 64 in strike 60 is aligned with opening 62, in the direction of door movement, but is of smaller size than opening 62. Thus, as will be explained below, the generally rectangularly shaped forward end 68 of the auxiliary bolt 26 can be received in opening 64 but this opening is of insufficient size to receive and capture the projecting end of the bolt head 12. The free leading edge or lip of the leg portion of the T-shaped strike 60 is bent downwardly, i.e., away from the door, as indicated at 70. The trailing edge of opening 64, in the closing direction of the door, defines a cam surface 72. The strike 60 is mounted to the door jamb by means of fasteners which pass through the spaced apertures 74, apertures being provided in the strike box 66 which register with apertures 74.

Figure 11:
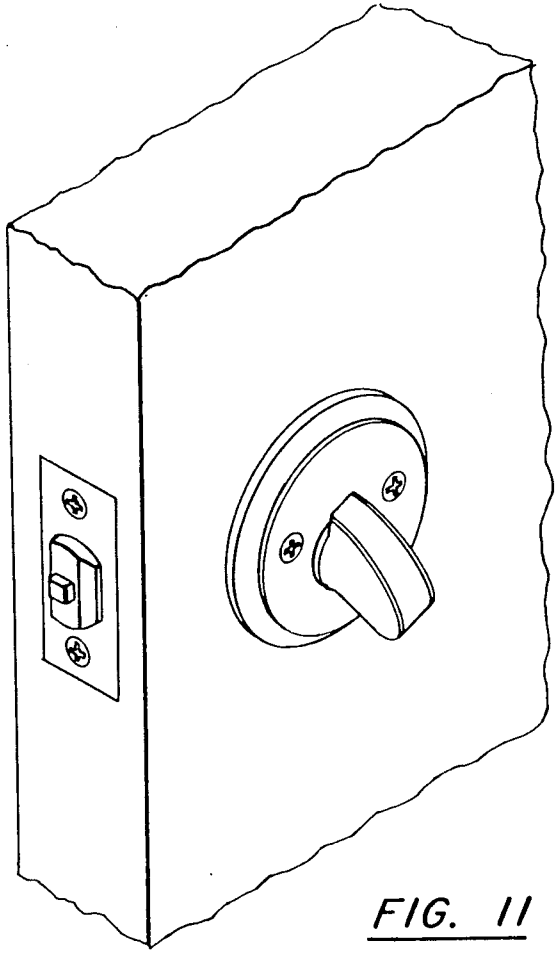
FIG. 11 is a perspective view of an automatic dead bolt lock in accordance with the present invention installed in a door and in the armed condition, a manual actuator for the lock being visible in FIG. 11.

FIGS. 1, 1A and 11 show the bolt subassembly in the partially extended, armed position with the door open. As the door is closed, an edge 75 of bolt head 12 will contact lip 70 on strike 60 and the bolt head and bolt arm 22 will be cammed back, i.e., the bolt will be forced toward the retracted position, i.e., the bolt head will be cammed to the right as the apparatus is shown in the drawings. During this initial bolt movement, because of the presence of opening 64 in the strike, the auxiliary bolt 26 will not be caused to move relative to the bolt head 12 but rather will travel with the bolt. Accordingly, a clearance which is provided between the auxiliary bolt and a projection 80 on arm 22 will not be taken up.

Figure 2:
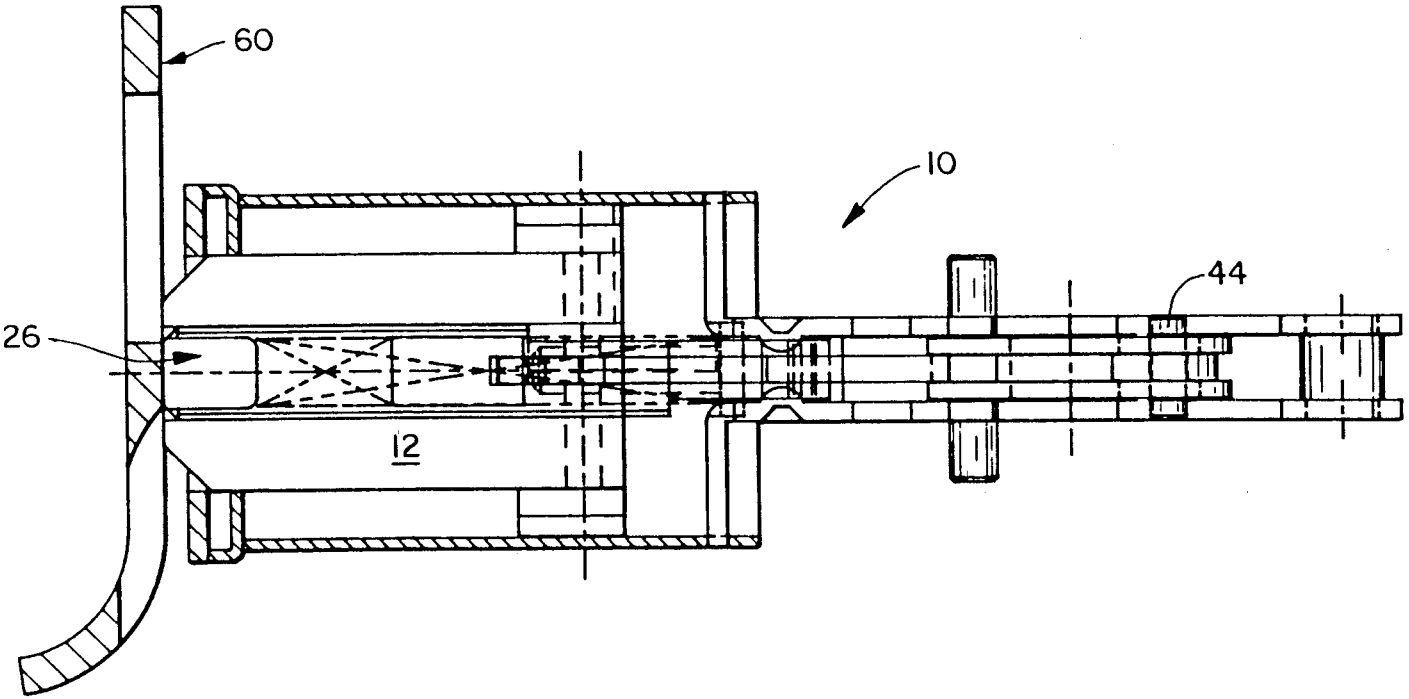
FIGS. 2 and 2A are views which respectively are the same as FIGS. 1 and 1A showing the bolt subassembly in the activated condition with the bolt not thrown.
Figure 2A:
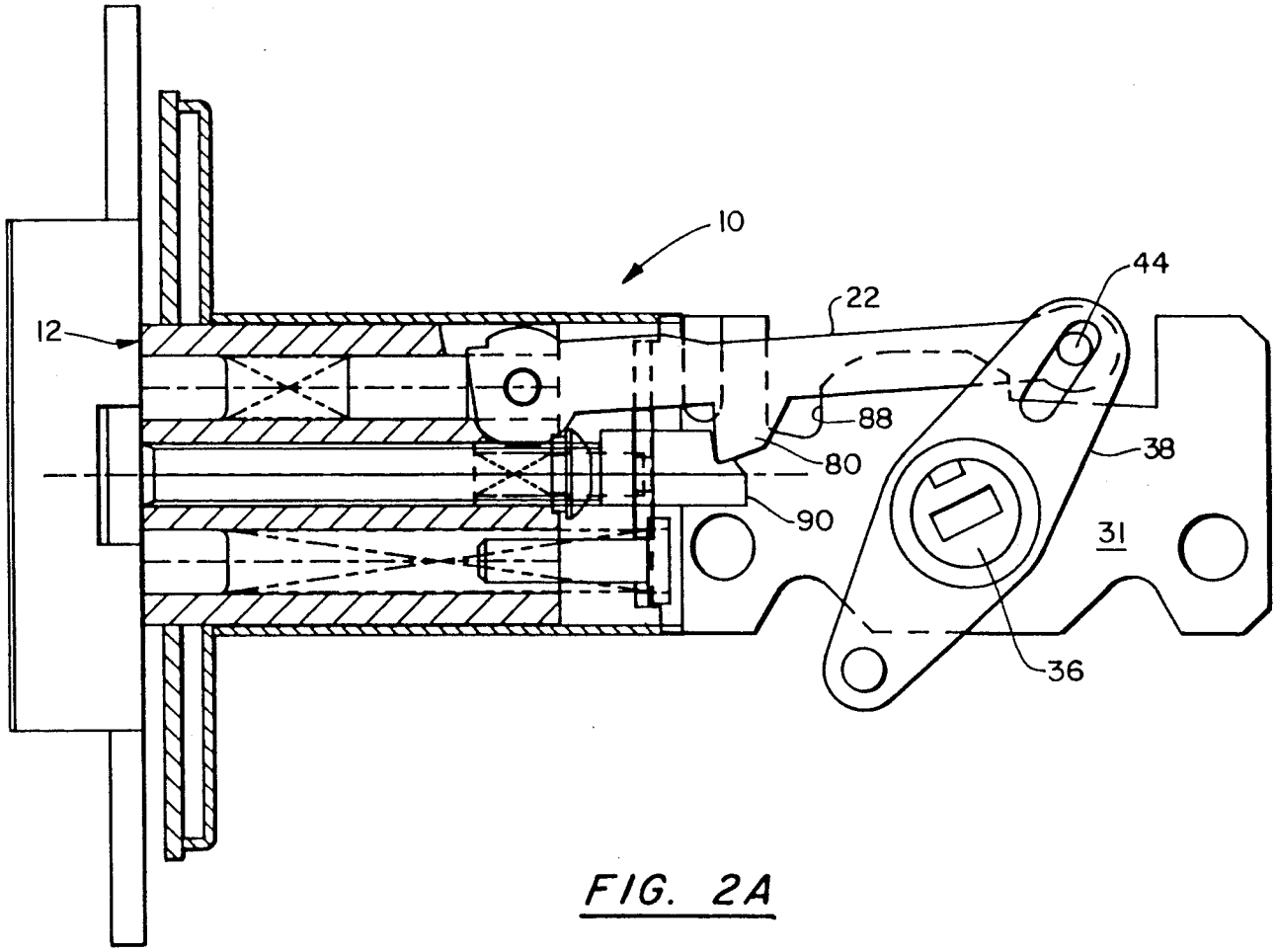

As the closure of the door continues, the auxiliary bolt 26 will be pushed rearwardly into the release position shown in FIGS. 2 and 2A when its square forward end 68 contacts the cam surface 72 on strike 60. This contact forces the auxiliary bolt 26 to slide inwardly, relative to bolt head 12 and thus also relative to bolt arm 22, until end 68 is flush with the most forwardly located part of the bolt head 12. This relative movement of auxiliary bolt 26, which overcomes the bias of the spring 28, takes up the above-mentioned clearance and results in the upward movement of the inwardly disposed end of bolt arm 22, i.e., the projection 80 of arm 22 is forced upwardly by contact with a cam surface 82 on the auxiliary bolt 26. During this upward movement the arm 22 will pivot counterclockwise about pin 46. The upward movement of the inner end of bolt arm 22 is guided by the travel of cam follower 44 in the slot 42 of lever 38. As may be seen from FIGS. 1–4, the cam follower 44 projects outwardly to both sides from bolt arm 22 and, with the lock in the armed position shown in FIGS. 1 and 1A, cam follower 44 is trapped behind catches 84 on the plates 31 and 32. The upward movement of the bolt arm 22 terminates with the projection 80 resting in a holding detent 86 of auxiliary bolt 26. This is the partially retracted, release position of the bolt subassembly where cam follower 44 is repositioned so as to be separated from the catches 84 and is held high enough to clear the catches, the holding action resulting from a clockwise directed force derived from spring 20.

It is to be noted that, should the door be reopened before the release position of FIGS. 2 and 2A has been reached as result of relative motion between auxiliary bolt 26 and bolt head 12 as described above, the bolt will not be fully extended. Rather, the cam follower 44 will simply slide forwardly until contact with catches 84 is reestablished and the lock will return to the armed condition of FIGS. 1 and 1A. This will prevent damage which might result from attempting to close the door with the bolt fully extended.

As the closing movement of the door continues after the release position has been reached, the bolt head 12 will move into alignment with the opening 62 in strike 60. The bolt will now shoot forwardly to the fully extended position shown in FIGS. 3, 3A and 15 under the action of the spring 16. As the bolt moves forwardly, cam follower 44 on arm 22 will be directed upwardly by angled cam surfaces 100 on the catches 84 of plates 31 and 32. The upward movement of cam follower 44, and thus of arm 22, will lift projection 80 on arm 22 out of holding detent 86 of auxiliary bolt 26. Auxiliary bolt 26, when released by the upward movement of projection 80, will also shoot forwardly, relative to the bolt head, in response to the force provided by spring 28. Forward movement of auxiliary bolt 26 will be stopped by contact between surfaces 102 and 104 respectively on auxiliary bolt 26 and bolt head 12. This relative forward movement of auxiliary bolt 26 will provide clearance for arm 22 to drop down into the dead locked position of the auxiliary bolt where surface 80 on the bolt arm 22 projection is in an abutting relationship to the rearwardly facing flat end surface 90 on auxiliary bolt 26. The extension of the bolt, and the resultant forward movement of bolt arm 22, will result in the counterclockwise rotation of hub 36 and lever 38 and the travel of cam follower 44 forwardly to the position where it drops into the aligned dead locking slots 88 in the plates 31 and 32. This dead locks the main bolt 12 in the forward locked position. As noted, the auxiliary bolt 26 will also be separately dead locked because, when the cam follower 44 drops into the slots 88, the bolt arm 22 will drop downwardly so that projection 80 is behind the flat rearwardly facing surface 90 on auxiliary bolt 26. The downward movement of the bolt arm 22 results from the force generated by spring 20, spring 20 being in compression between the bolt head 12 and a piston 92. Piston 92 is located in bore 18 in bolt head 12 and has a flat rearwardly facing end which cooperates with the angled forward end 94 of arm 22 to impart a clockwise torque to arm 22. Piston 92 will typically comprise a hardened roller pin which prevents sawing through the bolt head 12.

Figure 4:
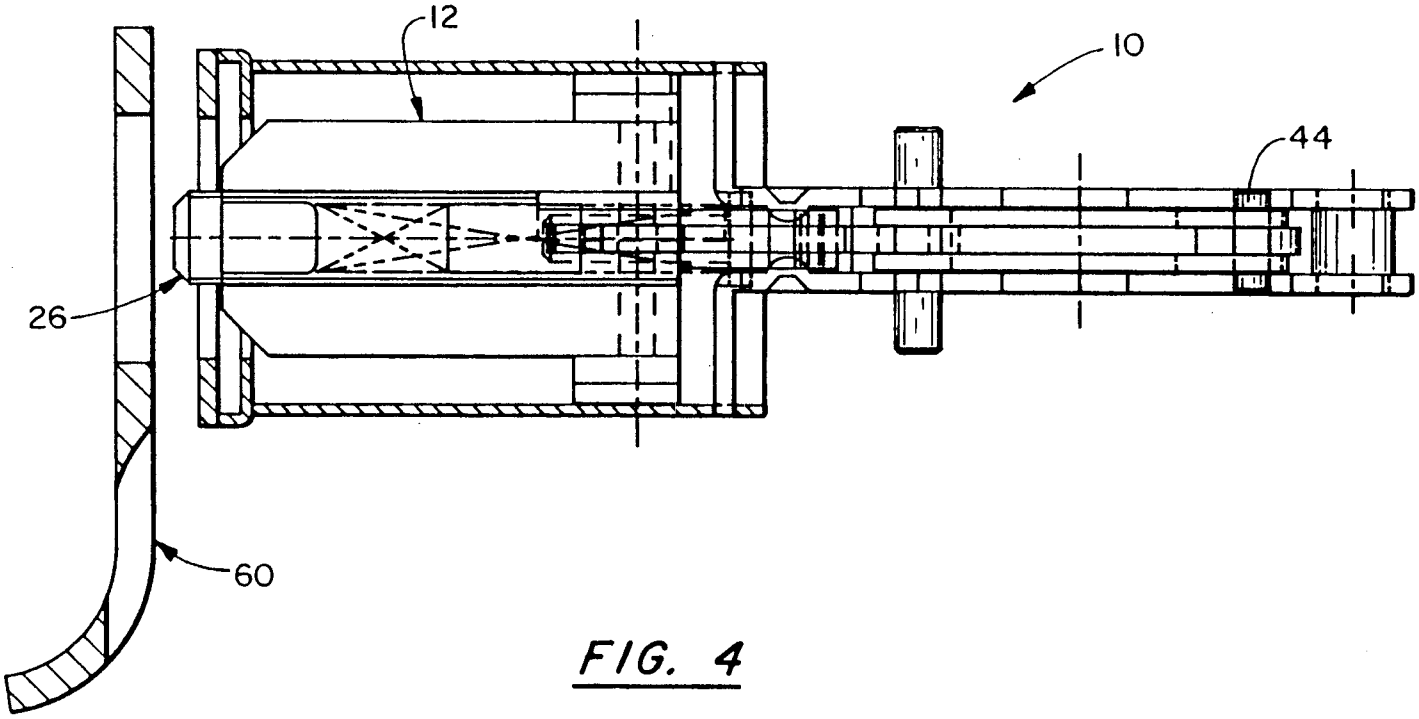
FIGS. 4 and 4A are views which respectively are the same as FIGS. 1 and 1A showing the bolt subassembly in the holdback, fully retracted condition.
Figure 4A:
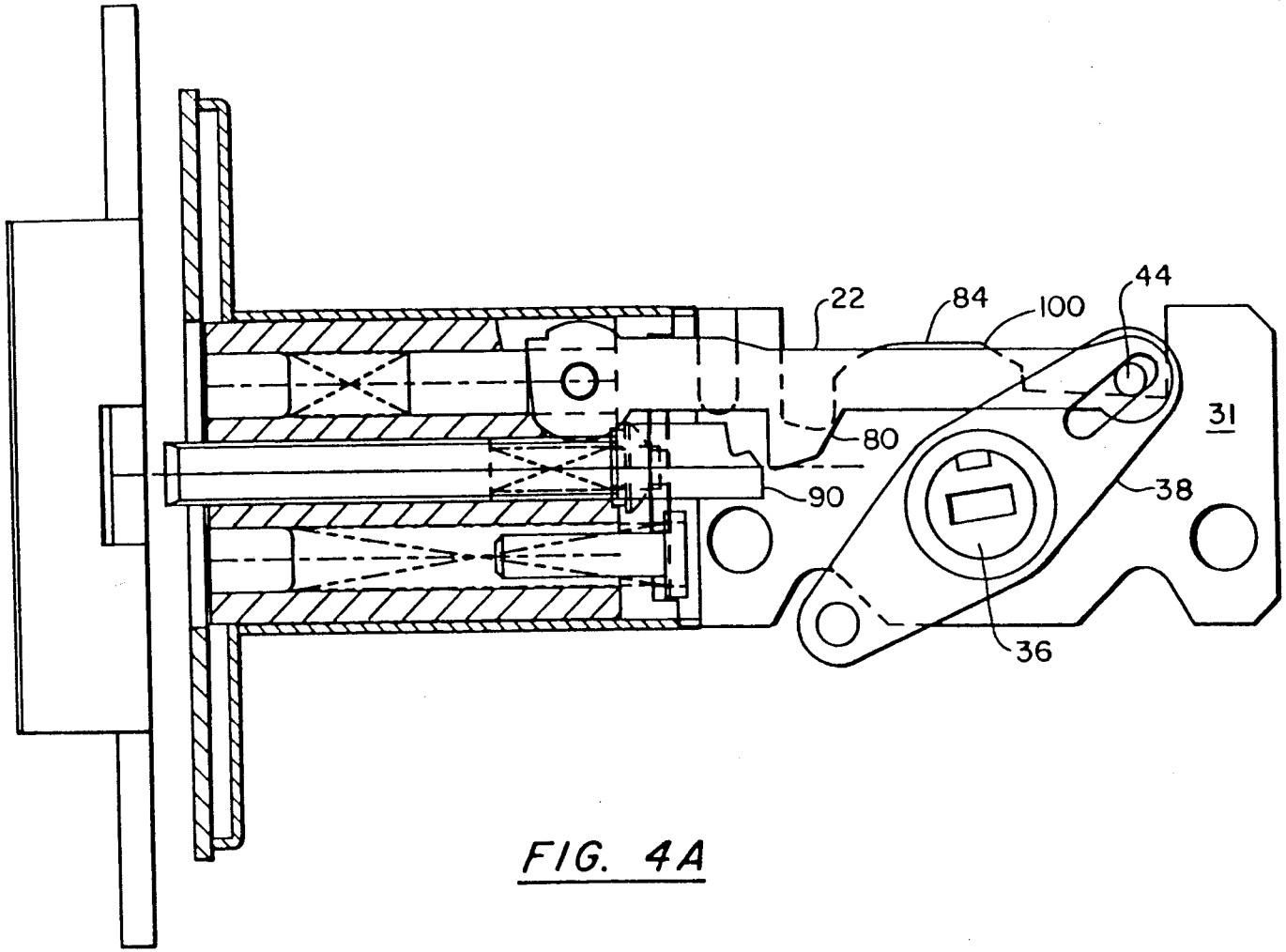

The door can be opened, i.e., the bolt withdrawn, through use of either an inside or an outside actuator. As noted above, the outside actuator may have a removable core or may be a key-in-knob cylinder with a tail piece that engages hub 36. In the case of a key-in-knob cylinder, i.e., a threaded mortise cylinder such as shown in U.S. Pat. No. 4,272,974, the lever 38 will customarily be double ended and will be provided with a second cam follower 40 adjacent to its second end, i.e., the end disposed oppositely with respect to slot 42. The cam follower 40 may, for example, cooperate with a cam on the mortise cylinder. The inside actuator will, as also previously noted, typically be a manual actuator such as shown in FIGS. 11–17. In either case, unlocking will result from imparting clockwise rotation to hub 36 to thereby retract the bolt. Rotation of hub 36 raises the cam follower 44 out of the dead locking slots 88 and subsequently pulls the bolt head, via the bolt arm 22, inwardly. When the bolt reaches its limit of motion in the retraction direction (the fully retracted position of FIGS. 4, 4A and 13), and presuming the door is in the open condition, the bolt head 12 will be withdrawn to a position where it is located inwardly with respect to the front (exposed) face of plate 52. Movement of the bolt head to the fully retracted position, accordingly, permits the end 68 of the auxiliary bolt 26 to clear the strike during opening of the door. Release of the actuator will, with the bolt head fully retracted, permit counterclockwise rotation of hub 36 as a result of the force provided by spring 16. This counterclockwise hub rotation will be stopped by cam follower 44 coming into contact with catches 84. Thus, when the actuator, i.e., either the key operated outside actuator or the inside actuator, is released with the door open and the bolt fully retracted, the auxiliary and main bolts will return to the position shown in FIGS. 1 and 2, i.e., the bolt spring 16 will urge the bolt forwardly until contact is reestablished between cam follower 44 and the rearward facing vertical surfaces of the catches 84 on the plates 30 and 32.

Since the armed condition of the lock depicted in FIGS. 1 and 1A comprises a partially extended position of the bolt head, the door will remain locked if the bolt is fully retracted and then allowed to return to the armed condition without the door being opened. Restated, when the door is closed and the bolt subassembly is in the armed condition, the side of the bolt head will extend outwardly beyond the flat edge 102 of opening 62 of the strike.

As will be described in detail below, the inside actuator may be provided with means for holding the bolt in the fully retracted or holdback position and may also or alternatively be provided with lock-out means which prevents the outside actuator from causing retraction of the bolt head.

Referring now to FIGS. 11–17, the manually operable inside actuator includes a knob or thumb turn 120. The knob 120 has a rotatable hub 122 which extends through an outer trim member or "rose" 124 and an inner liner 125. A tailpiece 126 is affixed to hub 122 in any suitable manner so as to be rotatable therewith.

Tailpiece 126 engages hub 36 of the bolt subassembly. A roll pin 128 is mounted on, and rotatable with, hub 122. Liner 125 is provided with an inwardly directed tubular extension 130 in which the hub 122 rotates. This tubular extension is provided, in the edge thereof which faces the door, with a roll pin receiving slot 132. The tubular extension 130 may also be provided with a second roll pin receiving slot 134.

Figure 12:
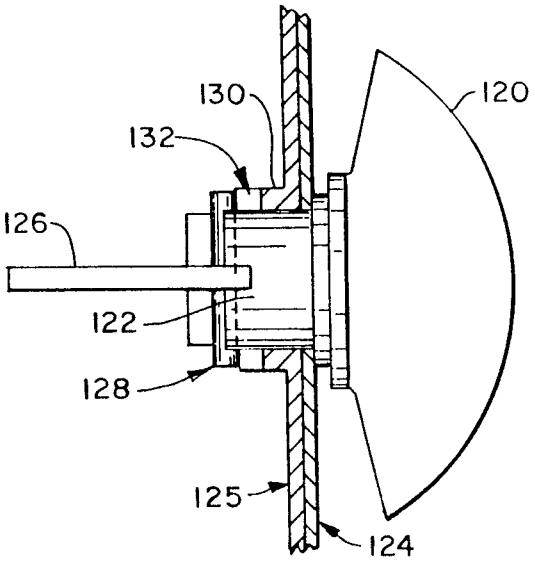
FIG. 12 is a cross-sectional, side elevation view of the actuator of the lock depicted in FIG. 11.

FIGS. 11 and 12 show the lock of the disclosed embodiment of the invention in the armed condition which may be considered the normal operating position. In this position the tailpiece 126 is engaged in the hub 36 of the bolt subassembly and the roll pin 128 lightly contacts the inner or door facing end of tubular extension 130 of liner 125.

Figure 14:
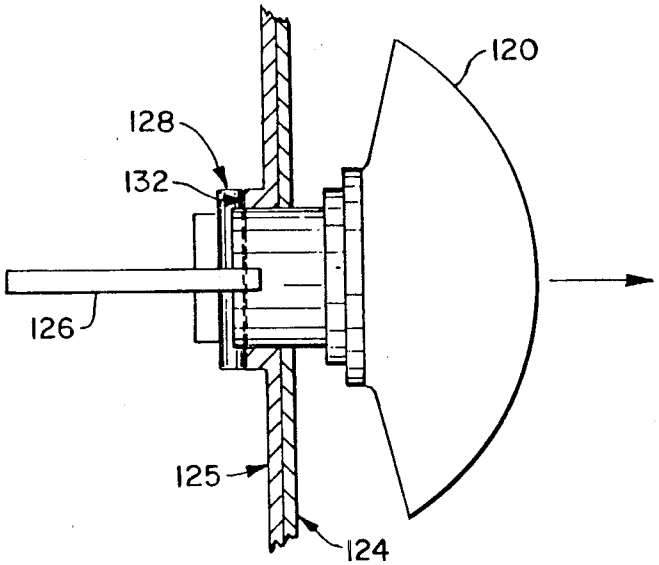
FIG. 14 is a view similar to FIG. 12 showing the actuator in the holdback condition.
Figure 13:
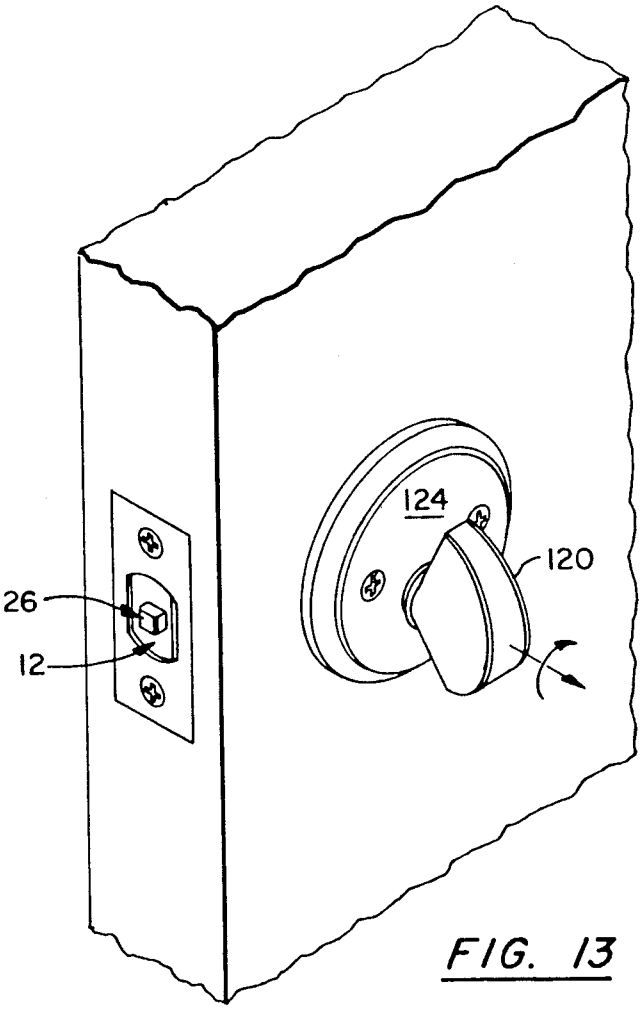
FIG. 13 is a perspective view, similar to FIG. 11, showing the lock in the holdback position.
Figure 16:
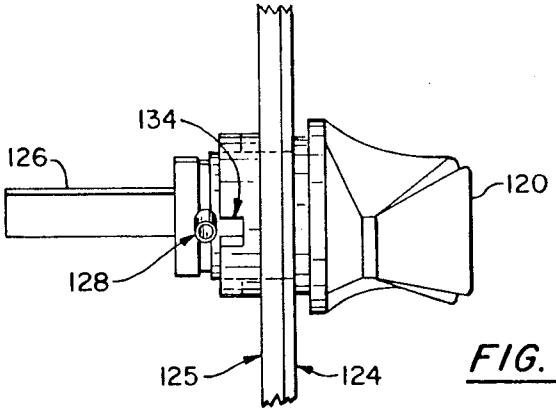
FIG. 16 is a view similar to FIGS. 12 and 14 showing the actuator in the position normally assumed with the bolt fully extended.
Figure 17:
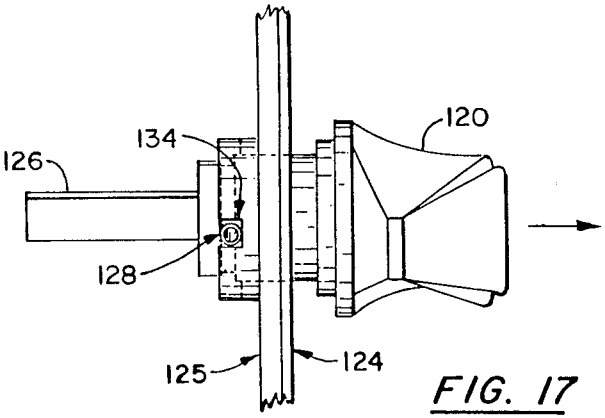
FIG. 17 is a view similar to FIG. 16 showing the actuator in the lock-out condition.

Referring to FIGS. 13 and 14, if it is desired to disable the bolt, the knob 120 is turned to fully retract the bolt. When the bolt is fully retracted the roll pin 128 is aligned with slot 132. Outward movement of knob 120 causes the roll pin 128 to be engaged in slot 132. The outward movement of the knob, and thus of tailpiece 126, however, does not disengage the tailpiece from the bolt subassembly hub 36. Accordingly, when the knob is released, the engagement of roll pin 128 in slot 132 will prevent the rotation of the tailpiece 126 in response to the force provided by bolt spring 16. Restated, the cooperation between roll pin 128 and slot 132 will, by locking tailpiece 126, prevent rotation of hub 36 and thus will keep the lock in the fully retracted or holdback position. Return to the normal operating state can be achieved simply by pushing knob 120 toward the surface of the door thus disengaging roll pin 128 from slot 132.

When the door is closed and the lock is in the hold back position, the hold back means must be disengaged to lock the door. Locking may then be accomplished by turning the manual actuator or key to lift cam 44 up and out of holding position against catch 84 by overcoming the clockwise downward force derived from spring 30. This allows the bolt to shoot forward to the deadlock position and provides the advantage of not having to open and then close the door to lock it.

Figure 3:
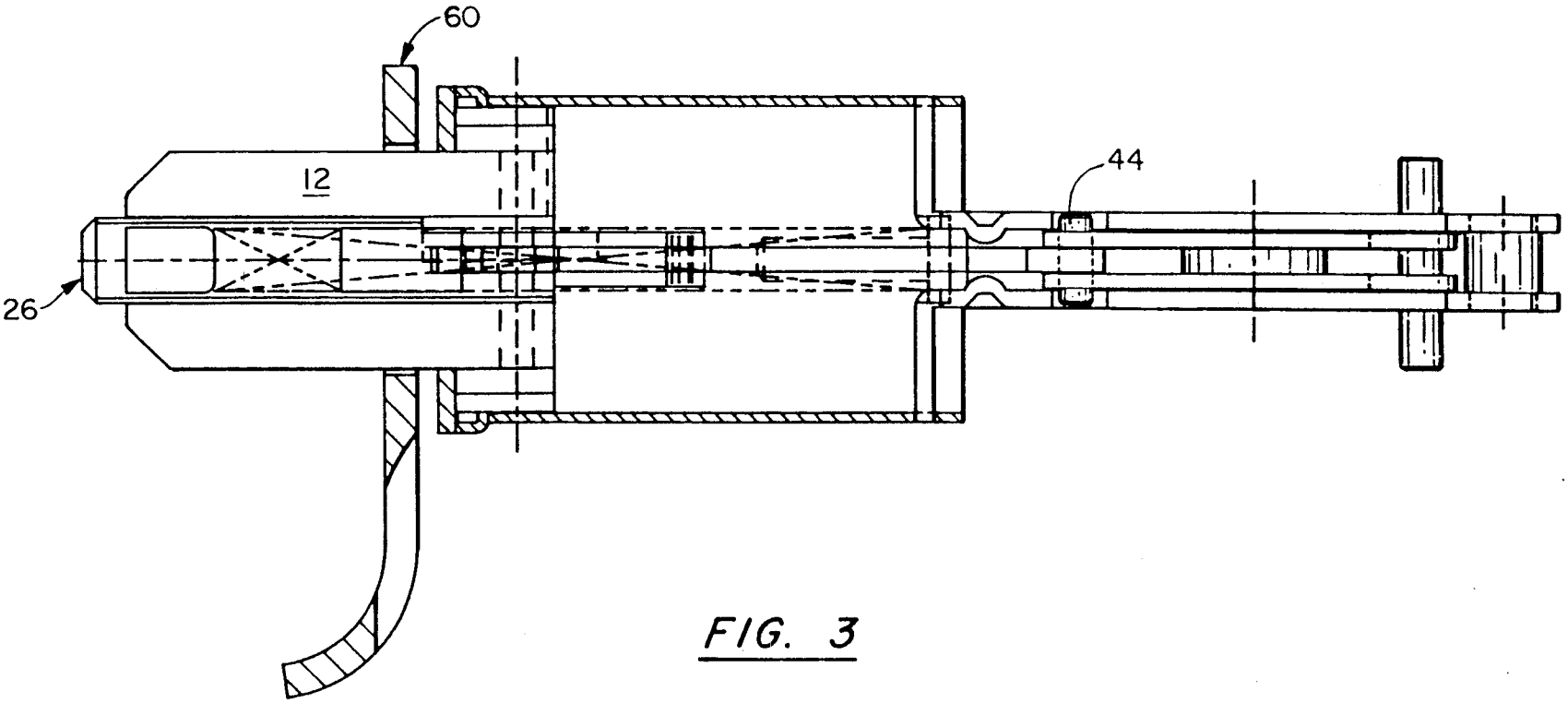
FIGS. 3 and 3A are view which respectively are the same as FIGS. 1 and 1A showing the bolt subassembly in the dead locked condition.
Figure 3A:
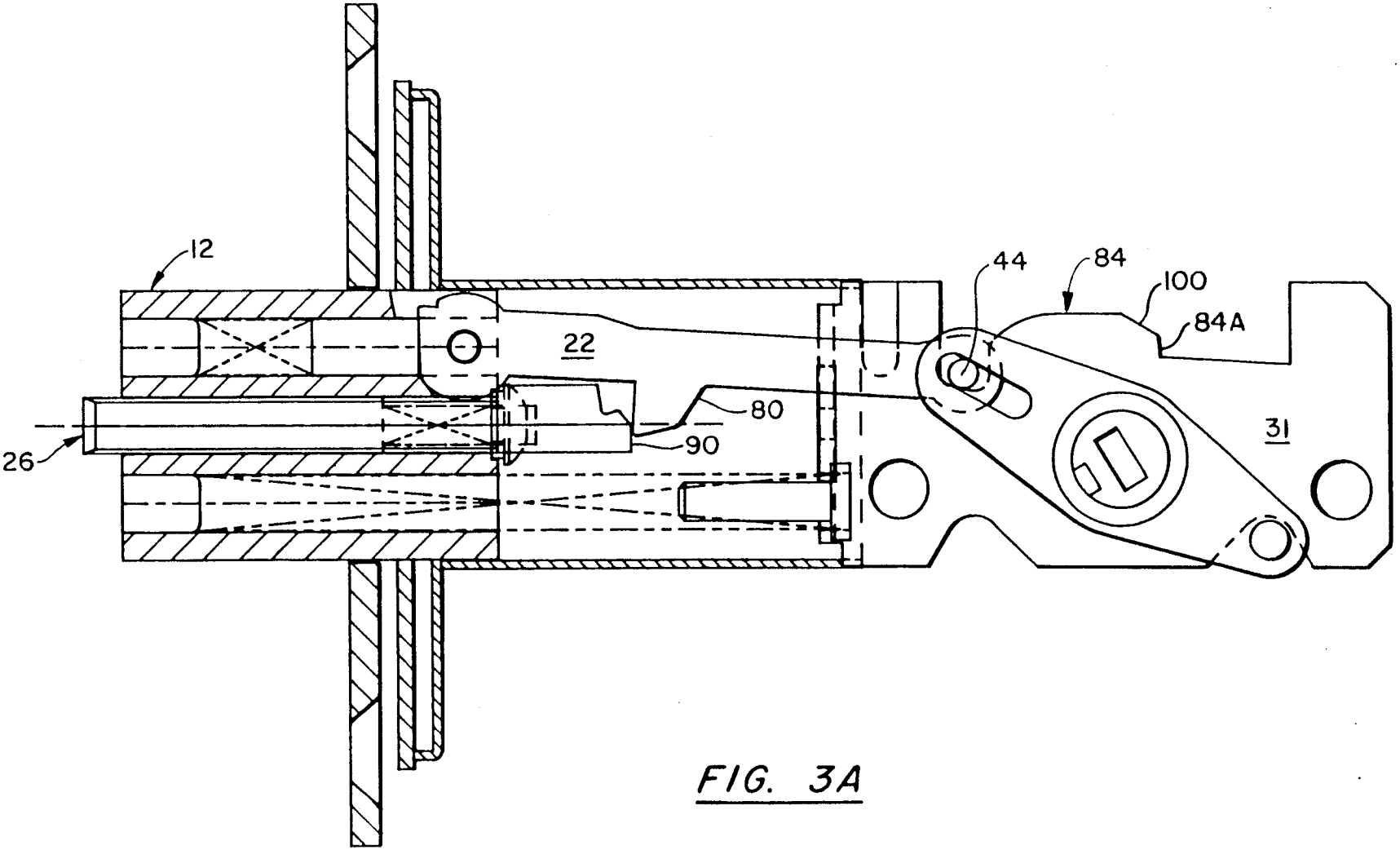
Figure 15:
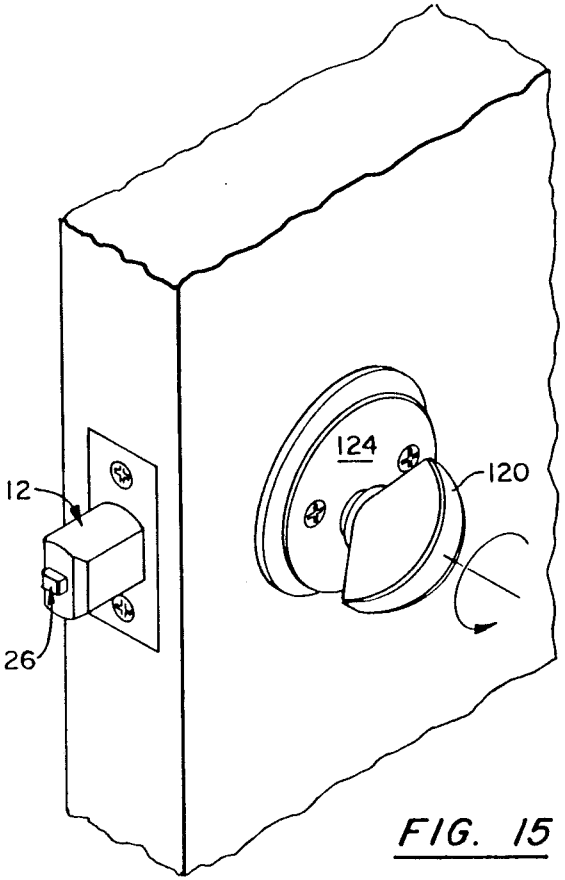
FIG. 15 is a perspective view similar to FIGS. 11 and 13 showing the lock in the lock-out position with the bolt fully extended.

In some instances it is also desired to provide a "lock-out" mode of operation in which the outside actuator may not be operated using a proper key. In order to accomplish lock-out, the tubular extension 130 of liner 125 is provided with a second roll pin engaging slot 134. Slot 134 is positioned so as to be axially aligned with roll pin 128 when the bolt is in the fully extended position as shown in FIGS. 3, 3A and 15. Thus, in order to implement the lock-out mode, once the bolt subassembly is in the dead-lock position, the user needs merely to pull knob 120 outwardly to engage roll pin 128 in slot 134. As discussed above with respect to the holdback function, the tailpiece 126 will remain engaged in the hub 36 of the bolt subassembly and thus rotation of the hub, for example by attempting to drive the cam follower 40 in the clockwise direction from the position in which it is shown in FIG. 3A, will be unsuccessful.

While a preferred embodiment has been shown and described, various modifications and substitutions may be made thereto without departing from the spirit and scope of the invention. Accordingly, it is to be understood that the present invention has been described way of illustration and not limitation.

What is claimed is:

1. In a lock, the lock having at least a first actuator and cooperating with a strike, an improved bolt subassembly comprising:

housing means, said housing means including a tubular receptacle;

a main bolt member mounted in said tubular receptacle for reciprocal movement in first and second opposite directions, said main bolt member extending from a first end of said receptacle and the amount of such extension being varied during said reciprocal movement;

first means for resiliently biasing said main bolt member in the first of said directions, said first direction being commensurate with the extension of said main bolt member from said tubular receptacle;

catch means on said housing means;

cam follower means for cooperating with said catch means to define a partly extended position of said main bolt member;

bolt arm means pivotally coupled to said main bolt member, said bolt arm means connecting said main bolt member to said cam follower means;

means coupling said cam follower means to the lock first actuator, said coupling means permitting movement of said cam follower means in two directions relative to said catch means, movement of said cam follower means in a first of said directions of movement thereof being in response to movement of said main bolt member in the said second direction of movement thereof;

an auxiliary bolt member, said auxiliary bolt member being supported on and movable with said main bolt member, said auxiliary bolt member being capable of limited motion relative to said main bolt member in the directions of main bolt member reciprocation, said auxiliary bolt member cooperating with said bolt arm means to cause pivotal motion of said bolt arm means whereby said cam follower means will move in its second direction of motion in response to movement of said auxiliary bolt member relative to said main bolt member;

second resilient biasing means for resiliently biasing said auxiliary bolt member to cause said auxiliary bolt member to extend from said main bolt member, movement of said auxiliary bolt member relative to said main bolt member in a direction opposite to the direction of the bias provided by said second biasing means repositioning said cam follower means to a location where said cam follower means is out of alignment with said catch means whereby said main bolt member may move to the fully extended position; and means for engaging said cam follower means when said main bolt member is in the fully extended position to thereby dead lock said main bolt member.

2. The apparatus of claim 1 further comprising:

means for stopping movement of said auxiliary bolt member in the said second direction of movement of said main bolt member when said main bolt member is in the fully extended position to thereby dead lock said auxiliary bolt member.

3. The apparatus of claim 1 further comprising:

third resilient biasing means for biasing said bolt arm means, the biasing of said bolt arm means imparting a force to said cam follower means in a direction opposite to the said second direction of motion thereof.

4. The apparatus of claim 1 wherein said coupling means comprises:

a rotatable hub mounted in said housing means;

lever means affixed to and extending in at least a first direction from said rotatable hub; and a cam follower engaging slot in said lever means, said cam follower moving in said first direction in response to rotation of said hub and being movable in said second direction by travel in said slot in response to pivotal movement of said bolt arm means.

5. The apparatus of claim 2 wherein said means for engaging said cam follower means to dead lock said main bolt includes a cam follower receiving slot in said housing, said third biasing means urging said cam follower means into said slot when said main bolt member is in the fully extended position.

6. The apparatus of claim 1 wherein said bolt arm means is provided with a camming projection thereon and wherein said auxiliary bolt member is provided with a camming surface which cooperates with said bolt arm means camming projection to cause said bolt arm means to pivot relative to said main bolt member should said auxiliary bolt member be caused to move in the second direction relative to said main bolt member when said main bolt member is in said partly extended position.

7. The apparatus of claim 6 wherein said camming projection on said bolt arm means is provided with a flat surface oriented generally transversely to the direction of movement of said main bolt member and wherein said auxiliary bolt member is provided with a flat surface on the end thereof disposed oppositely to the end which extends from said main bolt member, said flat surfaces on said bolt arm means projection and auxiliary bolt member being in abutting relationship when said cam follower means is engaged in said dead locking position whereby said auxiliary bolt member will be dead locked.

8. The apparatus of claim 1 wherein said bolt arm means and said coupling means define the maximum travel of said main bolt member in the second direction and wherein said apparatus further comprises:

means for capturing said main bolt member at its position of maximum travel in the second direction.

9. An automatic dead locking bolt assembly comprising;

a bolt housing;

a main bolt supported by said bolt housing for reciprocal movement between fully extended and withdrawn positions relative to said bolt housing, said main bolt having a partially extended position intermediate said fully extended and withdrawn positions;

an auxiliary bolt carried by and supported for reciprocal movement with and relative to said main bolt, said auxiliary bolt being movable between projected and retracted positions relative to said main bolt, said auxiliary bolt in its projected position extending beyond said main bolt in the direction of main bolt extension;

biasing means for urging said main bolt toward its fully extended position and said auxiliary bolt toward its projected position;

manually operable means for moving said main bolt from its fully extended to its withdrawn position, said main bolt being movable from its withdrawn position to its partially extended position in response to the release of said manually operable means when said main bolt is in its withdrawn position;

means for releasably retaining said main bolt in its partially extended position, said main bolt being releasable from its partially extended position in response to movement of said auxiliary bolt from its project position to its retracted position; and means for dead locking said main bolt in its fully extended position in response to movement of said main bolt to its fully extended position.

10. The automatic dead locking bolt assembly as set forth in claim 9 wherein said means for dead locking said main bolt comprises means for dead locking said auxiliary bolt in its projected position.

11. The automatic dead locking bolt assembly as set forth in claim 9 wherein said means for releasably retaining said main bolt in its partially extended position comprises said means for dead locking said main bolt in its fully projected position and said auxiliary bolt in its projected position.

12. An automatic dead locking bolt assembly as set forth in claim 11 wherein said means for releasably retaining said main bolt in its partially extended position comprises said manually operable means.

13. Automatic dead locking bolt assembly comprising:

a bolt housing defining a latching abutment and a locking abutment;

a main bolt supported by said bolt housing for reciprocal movement between fully extended and withdrawn positions relative to said bolt housing, said main bolt having a partially extended position intermediate said fully extended and withdrawn positions;

an auxiliary bolt carried by and supported for reciprocal movement with and relative to said main bolt, said auxiliary bolt being movable between projected and retracted positions relative to said main bolt, said auxiliary bolt in its projected position extending through and beyond said main bolt in the direction of main bolt extension;

first biasing means for urging said main bolt toward its fully extended position;

second biasing means for urging said auxiliary bolt toward its projected position;

manually operable means for moving said main bolt from its fully extended to its withdrawn position and including a rotary operating member journalled for angular movement on and relative to said bolt housing, a connecting member attached to said main bolt, and connecting means for attaching said connecting member to said operating member for movement therewith and relative thereto, said main bolt being movable from its withdrawn position to its partially extended position in response to release of said manually operable means when said main bolt is in its withdrawn position;

third biasing means for urging said connecting member toward abutting alignment with said latching abutment and for urging said connecting member toward abutting alignment with said locking abutment;

releasing means for moving said connecting member to a releasing position out of abutting alignment with said latching abutment in response to movement of said auxiliary bolt toward its retracted position;

said main bolt being freely movable to its fully projected position when said connecting member is in a released position, said connecting member being engaged with said locking abutment when said main bolt is in its fully extended position; and means for dead locking said auxiliary bolt in its projected position when said main bolt is in its fully extended position.

14. The automatic dead locking bolt assembly as set forth in claim 13 wherein said releasing means comprises co-engaging cam surfaces on said auxiliary bolt and said connecting member.

15. The automatic dead locking bolt assembly as set forth in claim 14 wherein said connecting member has a projection thereon defining one of said cam surfaces.

16. The automatic dead locking bolt assembly as set forth in claim 15 wherein said projection comprises said means for dead locking said auxiliary bolt in its projected position.

17. The automatic dead locking bolt assembly as set forth in claim 13 wherein said first biasing means comprises a first spring acting between said main bolt and said bolt housing, said second biasing means comprises a second spring acting between said main bolt and said auxiliary bolt and said third biasing means comprises a third spring acting between said main bolt and said connecting member.

18. The automatic dead locking bolt assembly as set forth in claim 13 including means for releasably securing said connecting member in a released position out of abutting alignment with said locking member when said auxiliary bolt is in its retracted position.

19. The automatic dead locking bolt assembly as set forth in claim 18 wherein said retaining means comprises a projection on said connecting member a detent recess defined by said auxiliary bolt and receiving an end portion of said projection therein.

20. The combination comprising an automatic dead locking bolt assembly and strike means for cooperating with said bolt assembly to dead lock an associated door, said bolt assembly having a bolt housing, a main bolt supported by said bolt housing for reciprocal movement between fully extended and withdrawn positions relative to said bolt housing, said main bolt having a partially extended position intermediate said fully extended and withdrawn positions, biasing means for urging said main bolt toward its fully extended position, means for releasably retaining said main bolt in said partially extended position, and means for releasing said main bolt from said partially extended position including an auxiliary bolt carried by and supported for reciprocal movement with and relative to said main bolt, said auxiliary bolt being movable between projected and retracted positions relative to said main bolt, said auxiliary bolt in its projected position extending beyond said main bolt in the direction of main bolt extension, said strike means including a strike plate for engaging said main bolt and said auxiliary bolt, said strike plate having an opening therein for receiving said main bolt in its projected position, and timing means for engaging said main bolt to move said main bolt from its partially extended position to its withdrawn position before engaging said auxiliary bolt to move said auxiliary bolt from its projected to its retracted position.

* * * * *